US011820574B2

(12) United States Patent
Zhou

(10) Patent No.: US 11,820,574 B2
(45) Date of Patent: Nov. 21, 2023

(54) SHIPPING CONTAINER AND PACKAGING CUSHION ASSEMBLY

(71) Applicant: Federal Express Corporation, Memphis, TN (US)

(72) Inventor: Yongquan Zhou, Oakland, TN (US)

(73) Assignee: Federal Express Corporation, Memphis, TN (US)

( * ) Notice: Subject to any disclaimer, the term of this patent is extended or adjusted under 35 U.S.C. 154(b) by 0 days.

(21) Appl. No.: 17/346,092

(22) Filed: Jun. 11, 2021

(65) Prior Publication Data

US 2022/0396410 A1 Dec. 15, 2022

(51) Int. Cl.
*B65D 81/133* (2006.01)
*B65D 71/40* (2006.01)

(52) U.S. Cl.
CPC ..... *B65D 81/133* (2013.01); *B65D 71/403* (2013.01); *B65D 2581/053* (2013.01)

(58) Field of Classification Search
CPC ..... B65D 71/403; B65D 81/133; B65D 2581/053
USPC ..... 206/433, 485, 486, 562, 588, 589
See application file for complete search history.

(56) References Cited

U.S. PATENT DOCUMENTS 2,367,345 A * 1/1945 Fischer ..... B65D 5/5038 206/418
2,459,921 A * 1/1949 Comer ..... B65D 71/0003 229/122.22
2,682,949 A * 7/1954 Whitehead ..... B65D 5/5014 229/142
2,760,631 A 8/1956 Stearn
3,115,247 A * 12/1963 Hauser ..... B65D 5/5023 192/105 BA
3,682,597 A * 8/1972 Husch ..... G01N 33/03 436/60

(Continued)

FOREIGN PATENT DOCUMENTS

| | | |
|---|---|---|
| DE | 29621264 | 2/1997 |
| FR | 2738228 | 3/1997 |
| WO | WO 2015/049702 | 4/2015 |

OTHER PUBLICATIONS

FR2738228 (A1), Patent Translate Powered by EPO and Google, 8 pages.*

(Continued)

*Primary Examiner* — Luan K Bui
(74) *Attorney, Agent, or Firm* — Fish & Richardson P.C.

(57) ABSTRACT

A shipping assembly is described. The assembly includes a shipping container, a bottom structure, and a top structure. The bottom and top structures retain objects in a spaced-apart arrangement within the shipping container. A paperboard sheet is folded into three horizontal layers to form the bottom structure. A first layer has apertures to retain the objects. A second layer is below and spaced apart from the first layer with a substantially flat surface below the first apertures. A third layer is below and spaced apart from the second layer. Another paperboard sheet is folded into two horizontal layers to form the top structure. A fourth layer has another set of apertures to retain the objects. A fifth layer is above and spaced apart from the fourth layer. The apertures are align to position the objects in the shipping container.

20 Claims, 12 Drawing Sheets

(56) References Cited

U.S. PATENT DOCUMENTS

| | | | | |
|---|---|---|---|---|
| 5,590,786 | A * | 1/1997 | Jaycox | B65D 77/0426 206/521 |
| 6,702,115 | B1 * | 3/2004 | Roper | B65D 5/5061 206/427 |
| 8,230,997 | B1 * | 7/2012 | McWilliams | B65D 5/5038 206/139 |
| 2006/0042983 | A1 * | 3/2006 | Liu | B65D 5/5061 206/588 |
| 2015/0210457 | A1 * | 7/2015 | DiMauro | B65B 61/207 53/472 |

OTHER PUBLICATIONS

International Search Report and Written Opinion in International Appln. No. PCT/US2022/032174, dated Sep. 13, 2022, 13 pages.

* cited by examiner

SHIPPING CONTAINER AND PACKAGING CUSHION ASSEMBLY

BACKGROUND

Shipping containers and packaging cushions can be employed in logistics transportation and package shipment as an assembly to contain objects. Some of the objects can be broken as the shipping container travels through a distribution channel. Existing packages are often designed for bulk retail distribution on pallets, and as such lack sufficient shock and vibration absorption or packaging cushions to protect non-palletized shipments of fragile goods. Other options include engineered protective packaging cushions, such as formed foam bottle carriers. However, engineered packaging cushions are generally tailored to specific product shapes and requires expensive tooling to produce.

SUMMARY

This specification relates to shipping container and packaging cushion assemblies. Implementations of the present disclosure include a shipping container assembly. The shipping container assembly includes a shipping container, a bottom structure, and a top structure. The bottom structure retains multiple objects in a spaced-apart arrangement within the shipping container. The bottom structure includes a first paperboard sheet folded to form a first set of layers. The first set of layers includes a first horizontal layer including multiple first apertures. Each of the first apertures are sized to retain a first end of one of the objects. The first set of layers includes a second horizontal layer below and spaced apart from the first horizontal layer. The second horizontal layer includes a substantially flat surface below the first apertures. The first set of layers includes a third horizontal layer below and spaced apart from the second horizontal layer. The top structure retains the multiple objects in a spaced-apart arrangement within the shipping container. The top structure includes a second paperboard sheet folded to form a second set of layers. The second set of layers includes a fourth horizontal layer including multiple second apertures. Each of the second apertures are sized to retain a second end of one of the objects. Each of the second apertures are arranged to align with one of the first apertures of the bottom structure when the bottom structure and the top structure are positioned in the shipping container. The second set of layers includes a fifth horizontal layer above and spaced apart from the fourth horizontal layer.

In some implementations, the second apertures are smaller than the first apertures.

In some implementations, the first apertures and the second apertures are the same shape.

In some implementations, the first apertures and the second apertures are a shape of a circle, a square, or a rectangle.

In some implementations, each of the bottom structure, the top structure, and the shipping container are double walled corrugated cardboard.

In some implementations, the bottom structure includes first sidewalls coupling the first horizontal layer to the third horizontal layer, second sidewalls coupling the third horizontal layer to the second horizontal layer, and a height of the first sidewalls is greater than a height of the second sidewalls.

In some implementations, at least one of the second sidewalls include a retaining tab to create a friction fit with another one of the second sidewalls and retain the bottom structure in a folded form.

In some implementations, the first sidewalls are sized to maintain the first horizontal layer spaced apart from the third horizontal layer.

In some implementations, the second sidewalls are sized to maintain the second horizontal layer spaced apart from the third horizontal layer.

In some implementations, at least one of the second sidewalls include at least one support tab extending between the second horizontal layer and the first horizontal layer.

In some implementations, a height of the at least one support tab is substantially the same as a distance by which the second horizontal layer is spaced apart from the first horizontal layer.

In some implementations, the second sidewalls include a first pair of sidewalls and a second pair of sidewalls. The first pair of sidewalls is located at opposite outer edges of the second horizontal layer and the second pair of sidewalls is located approximately midway between the first pair.

In some implementations, the second pair of sidewalls include retaining tabs to create a friction fit between the second pair of sidewalls and retain the bottom structure in a folded form.

In some implementations, each sidewall of both the first pair and the second pair of sidewalls include at least one support tab extending between the second horizontal layer and the first horizontal layer.

In some implementations, the top structure includes third sidewalls coupling the fourth horizontal layer to the fifth horizontal layer. The third sidewalls are sized to maintain the fourth horizontal layer spaced apart from the fifth horizontal layer.

In some implementations, the third sidewalls include at least four sidewalls of substantially equal height.

In some implementations, at least one of the third sidewalls include a retaining tab to create a friction fit with another one of the third sidewalls and retain the top structure in a folded form.

In some implementations, the first apertures are sized to form a friction fit with the first end of the objects.

In some implementations, the second apertures are sized to form a friction fit with the second end of the objects.

In some implementations, the objects are breakable vessels.

In some implementations, a width and a length of the bottom structure substantially match inner dimensions of the shipping container and a width and a length of the top structure substantially match the inner dimensions of the shipping container.

Further implementations of the present disclosure include a shipping assembly. The shipping assembly includes a shipping container, bottom structure, and a top structure.

The bottom structure retains multiple objects in a spaced-apart arrangement within the shipping container. The bottom structure includes a first paperboard sheet folded to form a first set of layers. The first set of layers includes a first horizontal layer including multiple first apertures. Each first aperture is sized to retain a first end of one of the objects. The first set of layers includes a second horizontal layer below and spaced apart from the first horizontal layer. The second horizontal layer includes a substantially flat surface below the first apertures. The bottom structure includes at least one support tab extending between the second horizontal layer and the first horizontal layer. The bottom structure includes a third horizontal layer below and spaced apart from the second horizontal layer. The bottom structure includes first sidewalls coupling the first horizontal layer to the third horizontal layer. The first sidewalls are sized to maintain the first horizontal layer spaced apart from the third horizontal layer. The bottom structure includes second sidewalls coupling the third horizontal layer to the second horizontal layer. The second sidewalls are sized to maintain the second horizontal layer spaced apart from the third horizontal layer The top structure retains the multiple objects in a spaced-apart arrangement within the shipping container. The top structure includes a second paperboard sheet folded to form a second set of layers. The second set of layers includes a fourth horizontal layer including multiple second apertures. Each second aperture is sized to retain a second end of one of the objects. Each second aperture is arranged to align with one of the first apertures of the bottom structure when the bottom structure and the top structure are positioned in the shipping container. The top structure includes a fifth horizontal layer above and spaced apart from the fourth horizontal layer. The top structure includes third sidewalls coupling the fourth horizontal layer to the third horizontal layer. The third sidewalls are sized to maintain the fourth horizontal layer spaced apart from the fifth horizontal layer.

Further implementations of the present disclosure include packaging for a shipping container. The packaging for a shipping container includes a first paperboard sheet and a second paperboard sheet.

The first paperboard sheet is folded into a bottom structure for objects placed in the shipping container. The first paperboard sheet includes a first region, a pair of first sidewall regions, a pair of second regions, a pair of second sidewall regions, a pair of third regions, and a pair of third sidewall regions.

The first region includes multiple of first apertures. Each of the first sidewall regions are coupled to an opposite side of the first region and separated therefrom by a first set of perforations. Each of the second regions are coupled to different ones of the first sidewall regions and separated therefrom by a second set of perforations. Each of the second sidewall regions are coupled to different ones of the second regions and separated therefrom by a third set of perforations. Each of the third regions are coupled to different ones of the second sidewall regions and separated therefrom by a fourth set of perforations. Each of the third sidewall regions are coupled to different ones of the third regions and separated therefrom by a fifth set of perforations.

The second paperboard sheet is folded into a top structure for the objects. The second paperboard sheet includes a fourth region, a pair of fourth sidewall regions, a pair of fifth regions, and a pair of fifth sidewall regions.

The fourth region includes multiple second apertures. Each of the fourth sidewall regions are coupled to an opposite side of the fourth region and separated therefrom by a sixth set of perforations. Each of the fifth regions are coupled to different ones of the fourth sidewall regions and separated therefrom by a seventh set of perforations. Each of the fifth sidewall regions are coupled to an opposite side of the fourth region and separated therefrom by a eighth set of perforations.

In some implementations, each of the first, second, third, fourth, and fifth sets of perforations form lines between a first common edge and a second common edge. The first common edge and the second common edge are each common to the first region, the second regions, and the third regions.

In some implementations, the second sidewall regions include retaining tab structures formed at each of the first common edge and the second common edge.

In some implementations, each of the sixth, seventh, and eight sets of perforations form lines between a third common edge and a fourth common edge. The third common edge and the fourth common edge are each common to the fourth region and the fifth regions.

In some implementations, the fifth sidewall regions include retaining tab structures formed at each of the third common edge and the fourth common edge.

Particular implementations of the subject matter described in this specification can be implemented so as to realize one or more of the following advantages and address the shortcomings of existing product packaging.

Implementations provide a shipping assembly that uses environmental friendly, recyclable, and sustainable materials to economically ship fragile consumer goods directly to consumers. For example, implementations of the present disclosure can be made from recyclable paperboard for lightweight items or corrugated board for heavyweight items. In addition, implementations can be unfolded and reused for different size/shape objects. Implementations provide sufficient shock and vibration absorption or packaging cushion to prevent or minimize damage during transit. For example, implementations are configured to include shock absorbing zones and/or retain objects in a fixed position spaced away from each other and from the sides of a shipping box where the objects could be impacted if the box is mishandled. Implementations can also be manufactured at significantly lower cost than current engineered packaging cushion solutions. For example, implementations of shipping assemblies disclosed herein do not require expensive upfront-tooling setups required for engineered solutions. Instead, implementations can be formed simply press cutting and perforating flat sheets paperboard or corrugated board. In addition, implementations of the packaging can be stored and shipped as flat sheets, thereby, making more efficient use of storage and shipping space for the shipping assembly components themselves. Because the shipping assemblies are formed from flat paperboard, or corrugated board, the apertures used to secure objects can be cut to various sizes to accommodate many different size/shaped objects without the need to retool a manufacturing line and/or replace molding dies.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

A distribution channel for sending and receiving shipments generally employs shipping containers and packaging cushions to protect the shipped objects. The objects can include breakable objects. Breakable objects can crack, fracture, or shatter when a threshold force or repetitive threshold force is transmitted to the breakable object. The breakable objects can be glass. Some breakable objects can be filled with liquid. When the threshold force or the repetitive threshold force breakable object cracks, fractures, or shatters, the breakable object cracks, fractures, or shatters and the contents (e.g., liquid, powder, gas) can flow out of the breakable object and contaminate other breakable objects. Additionally, pieces of broken objects or the contents of the broken objects can harm the user.

While most shipping containers for breakable objects are made of recyclable corrugated boards, some of the traditional shipping containers for breakable objects are made of plastic or wood which make recycling shipping containers difficult and costly. If not recycled, those plastic or wood shipping containers may be sent to land-fills directly, end up at land-fills, or are dumped into the ocean where they remain and do not be decomposed, polluting the land or ocean. Additionally, these plastic materials may contaminate water and/or injure fish or other marine animals.

The present disclosure describes a shipping assembly (e.g., packaging) that can be made from flat sheets of paperboard or corrugated board. The paperboard or corrugated board is cut and perforated according to unique patters that permit it to be folded into top and bottom cushion support structures that provide shock absorption for breakable objects placed in a shipping container.

Figure 1:
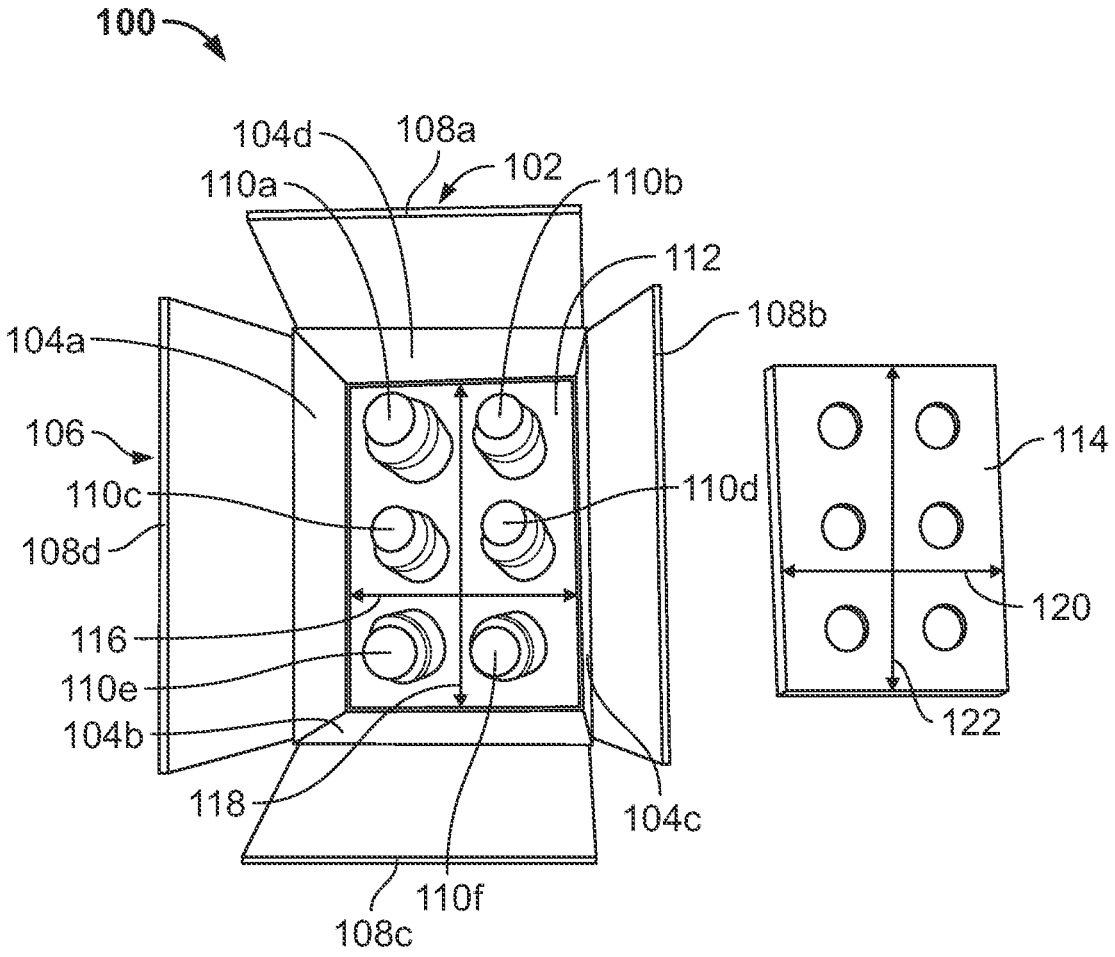
FIG. 1 is a perspective view of a shipping container and packaging cushion assembly.

FIG. 1 illustrates a perspective view of an exemplary shipping assembly 100. The shipping assembly 100 includes a shipping container 102, a bottom cushion support structure 112, and a top cushion support structure 114. One or more objects 110*a*-110*f* can be placed in the shipping container 102 for shipment.

The shipping container 102 can be a box. The shipping container 102 is defined by six surfaces. A first surface (not shown) is a bottom to the box. A second surface 104*a*, a third surface 104*b*, a fourth surface 104*c*, and a fifth surface 104*d* define the sides of the box. A top surface 106 of the shipping container is defined by four top panels 108*a*-108*d* which fold together to create the top surface. Two or more of the top panels 108*a*-108*d* are fastened together to seal the shipping container 102 shut. For example, top panels 108*a* and 108*c* can be folded toward an interior of the shipping container 102 and then the top panels 108*b* and 108*d* can be folded toward each other and taped together with a packing tape (not shown) by the user.

The shipping container 102 can be rectangular (as shown). Alternatively, the shipping container 102 can be square, triangular, or circular. The shipping container 102 can be paperboard, corrugated board. The corrugated board can be single walled or double walled. The corrugated board can be paper or plastic.

The shipping assembly 100 includes the bottom cushion support structure 112 and the top cushion support structure 114. The cushion support structures 112, 114 retain the objects 110*a*-110*f* in a spaced-apart arrangement within the shipping container 102 and provides shock absorption for the objects 110*a*-110*f*.

Figure 2A:
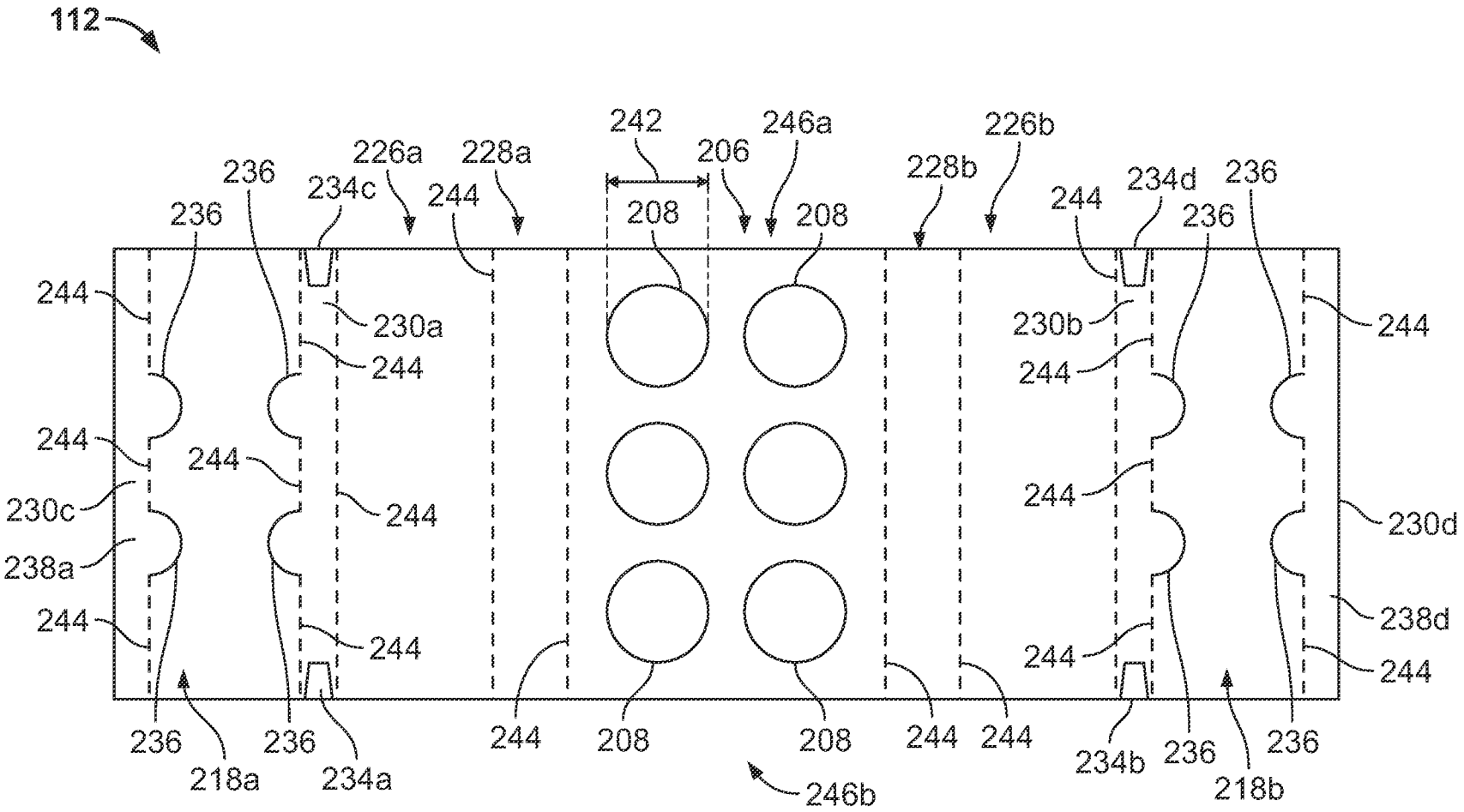
FIG. 2A is a top view an example unfolded bottom cushion support structure of FIG. 1.
Figure 2B:
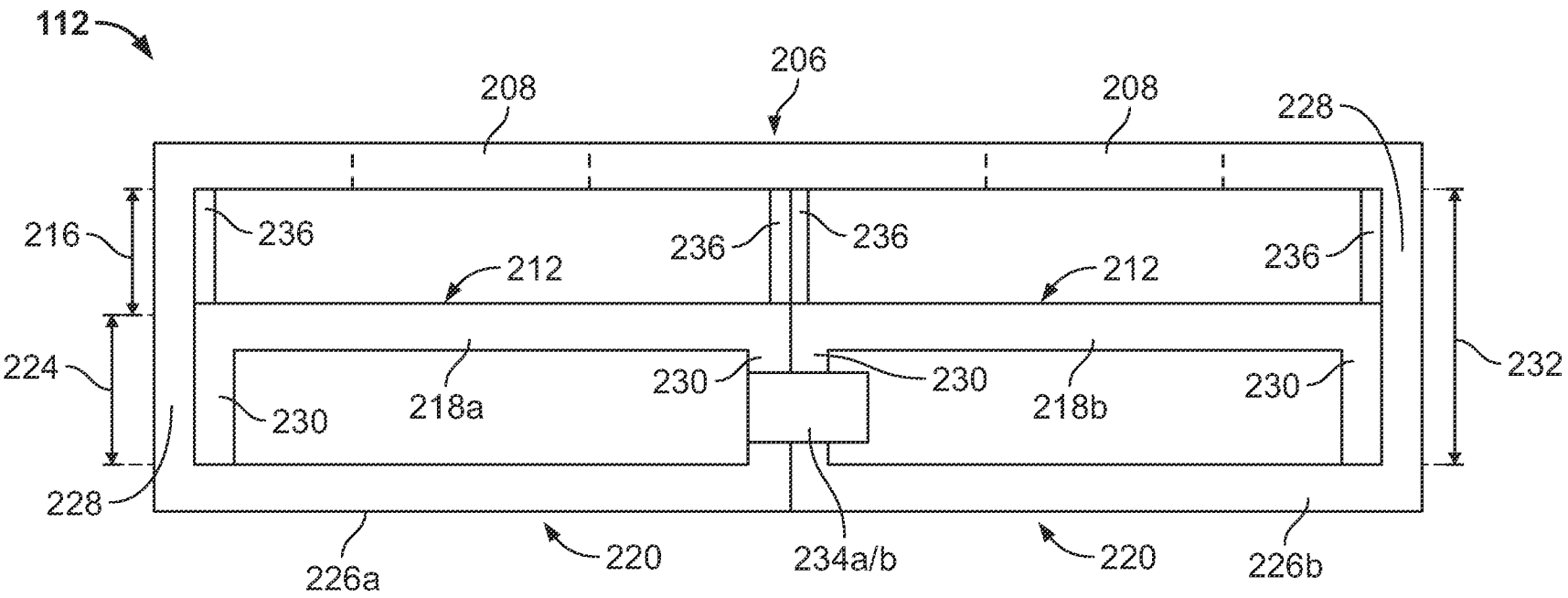
FIG. 2B is a side view an example folded bottom cushion support structure of FIG. 1.

FIG. 2A is a top view an example unfolded bottom cushion support structure 112 of FIG. 1 and FIG. 2B is a side view an example folded bottom cushion support structure of FIG. 1. The unfolded bottom cushion support structure 112 is a paperboard sheet 202 which can be folded to form a folded bottom cushion support structure 112 (e.g., as shown in FIGS. 2C-2G). Alternatively, the paperboard sheet 202 can be a corrugated board sheet. The sheet 202 is formed into multiple regions 206, 228*a*, 228*b*, 226*a*, 226*b*, 230*a*, 230*b*, 218*a*, 218*b*, 230*c*, and 230*d* each separated by perforations 244. The regions, when folded at the perforations 244, form multiple layers (e.g., first or top layer 206, second or middle layer 212, and third or bottom layer 220). The center region forms the first or top layer 206. The top layer 206 includes multiple apertures 208. A pair of sidewall regions 228*a*, 228*b* border the center region (e.g., layer 206) on opposite sides. When folded, the sidewall regions 228*a*, 228*b* will form outer sidewalls 228 of the bottom cushion support structure 112. A pair of second regions 226*a*, 226*b* border each of the two sidewall regions 228*a*, 228*b*. When folded, the second regions 226*a*, 226*b* will form the bottom layer 220 of the bottom cushion support structure 112. A second pair of sidewall regions 230*a*, 230*b* border the second regions 226*a*, 226*b*. When folded, the second pair of sidewall regions 230*a*, 230*b* will from a first set of sidewalls 228 that support the middle layer 212 and separate the middle layer 212 from the bottom layer 220. A pair of third regions 218*a*, 218*b*, border the second set of sidewall regions 230*a*, 230*b*. When folded the third pair of regions 218*a*, 218*b* will form the middle layer 212 of the support structure. A third pair of sidewall regions 230*c*, 230*d* border the third regions 218*a*, 218*b*. When folded the third pair of sidewall regions will form a second set of sidewalls 228 that support the middle layer 212 and separate the middle layer 212 from the bottom layer 220.

In some implementations, one or both of the second and third pairs of sidewall regions 230*a*-230*d* can include support tabs 236. The support tabs 236 are sized such that when the bottom cushion support structure is folded, the support tabs 236 provide additional structural support to the bottom of the top layer 206. As shown in FIG. 2B, the support tabs 236 extend between the middle layer 212 and the top layer 206 and act as pillars to support the top layer 206 above the middle layer 212.

In some implementations, the second pair of sidewall regions 230*a*, 230*b* can include interlocking tabs 234*a*-234*d*. The interlocking tabs 234*a*-234*d* can be used to retain the bottom cushion support structure 112 in the folded configuration, e.g., as shown in FIGS. 2B and 2G.

FIGS. 2C-2G illustrate the steps of folding the bottom cushion support structure 112 of FIG. 1. The first paperboard sheet 202 is folded to form a first set of layers 206, 212, 220. The first set of layers 206, 212, 220 includes a first horizontal layer 206. The horizontal layer 206 includes multiple first apertures 208. Each of the first apertures 208 are sized to retain first ends 210*a*-210*f* of each of the shipping objects 110*a*-110*f*, respectively.

Each of the first apertures 208 can be the shape of a circle (e.g., as shown in FIG. 2A), a square, or a rectangle. Each of the first apertures 208 can be the same shape. Alternatively, one or more of first apertures 208 can be different shapes. Each of the first apertures 208 are sized to form a friction fit with the respective first ends 210*a*-210*f* of the shipping objects 110*a*-110*f*.

The first set of layers 206, 212, 220 includes a second horizontal layer 212. The second horizontal layer 212 is below the first horizontal layer 206. The second horizontal layer 212 is spaced apart from the first horizontal layer 206 by a height 216. The second horizontal layer 212 serves as a floor upon which the objects 110 sit when place in the apertures 208 of the bottom cushion support structure 112. The second horizontal layer 212 is a substantially flat surface below the multiple first apertures 208. The second horizontal layer 212 is formed by a pair of second regions 218*a* and 218*b*.

The first set of layers 206, 212, 220 includes a third horizontal layer 220. The third horizontal layer 220 is below the second horizontal layer 212. The third horizontal layer 220 is spaced apart from the second horizontal layer 212 by a distance 224. This distance 224 provides separation between the objects 110 and the outer packaging of a shipping box in which the objects 110 are contained. The distance 224 between layers 212 and 220 also absorbs shock and provides some protection for the objects 110 against impact to the shipping container 102. The third horizontal layer 220 is a substantially flat surface below the second horizontal layer 212. The third horizontal layer 220 is formed by a pair of third regions 226*a* and 226*b*.

The bottom cushion support structure 112 includes sidewalls coupling each of the three horizontal layers 206, 212, and 220. For instance, a first set of sidewalls 228 couple the first horizontal layer 206 to the third horizontal layer 220. A second set of sidewalls 230 couple each of the pair of the third regions 226*a* and 226*b* which make up the third horizontal layer 220 to each of the pair of second regions 218*a* and 218*b* which make up the second horizontal layer 212.

A height 232 of the first sidewalls 228 is greater than the height 224. The height 224 also corresponds to the height of the second sidewalls 230. In the illustrated example, the first sidewalls 228 are sized to maintain the first horizontal layer 206 spaced apart from the third horizontal layer 220 and from the second horizontal layer 212. The second sidewalls 230 are sized to maintain the second horizontal layer 212 spaced apart from the third horizontal layer 220.

Bottom cushion support structure 112 includes a first retaining tab 234*a* on one of the second sidewalls 230. The first retaining tab 234*a* creates a friction fit with the opposing/adjoining other second sidewall 230 to retain the bottom cushion support structure 112 in a folded form. The first retaining tab 234*a* can engage a second retaining tab 234*b* on the other second sidewall 230, substantially similar to the first retaining tab 234*a* to create the friction fit. The first retaining tab 234*a* and the second retaining tab 234*b* form a pair of retaining tabs. Another pair of retaining tabs 234*c* and 234*d* can be positioned on an opposite side of the second sidewalls 230 to create another friction fit to retain the bottom cushion support structure 112 in the folded form.

The second sidewalls 230 can include two pair of sidewalls 230 supporting and extending between the second horizontal layer 212 and the third horizontal layer 220. One pair of sidewalls 230 are located at opposite outer edges (e.g., 238*a*, 238*b* shown in FIG. 2A, respectively, of the second horizontal layer 212. The other pair of sidewalls 230 are located approximately midway between the first pair of sidewalls 230. This second pair of sidewalls 230 are adjacent to each other, when the bottom cushion support structure 112 is in a folded configuration, and can include retaining tabs 234*a*-234*d*.

The second pair of sidewalls 230 can include the pair of retaining tabs 234*c* and 234*d* previously described. The pair of retaining tabs 234*c* and 234*d* are positioned on an opposite side of the second sidewalls 230 from the sidewalls 230 to create another friction fit to retain the bottom cushion support structure 112 in the folded form.

In some cases, each sidewall 230 of both the first pair and the second pair of sidewalls 230 include at least one of support tabs 236 extending between the second horizontal layer 212 and the first horizontal layer 206.

Bottom cushion support structure 112 includes support tabs 236. In some examples, the support tabs 236 are coupled to and extend from one of the pair of second regions 218*a* which make up the second horizontal layer 212. The support tabs 236 are coupled to and extend from the other of the pair of second regions 218*b* which make up the second horizontal layer 212. In some examples, the support tabs 236 are coupled to and extend from the sidewall regions (e.g., 230*a*-230*d* shown in FIG. 2A) that form the second sidewalls 230. In either example, the support tabs 236 extend between the second horizontal layer 212 and the first horizontal layer 206. The support tabs 236 support and space the first horizontal layer 206 from the second horizontal layer 212. The height of at least one of the support tabs 236, which is the same as height 216, can be substantially the same as a distance by which the second horizontal layer 212 is spaced apart from the first horizontal layer 206.

Each of the portions of the bottom cushion support structure 112 (the first horizontal layer 206, the first sidewalls 228, the pair of the third regions 226*a* and 226*b*, the second sidewalls 230, the pair of second regions 218*a* and 218*b*, and the second pair of sidewalls 230) have two common edges 246*a* and 246*b*. Referring to FIG. 2A, each of the regions of the bottom cushion support structure 112 are separated from each other by perforations 244. The regions of the unfolded bottom cushion support structure 112 are folded along the perforations 244 to form the folded bottom cushion support structure 112. The perforations 244 extend from the common edge 246*a* to the common edge 246*b*.

Referring to FIG. 1, the shipping assembly 100 includes the top cushion support structure 114. The top cushion support structure 114 retains the one or more shipping objects 110*a*-110*f* in a spaced-apart arrangement within the shipping container 102. The top cushion support structure 114 is generally similar to the bottom cushion support structure 112 previously described.

Figure 3A:
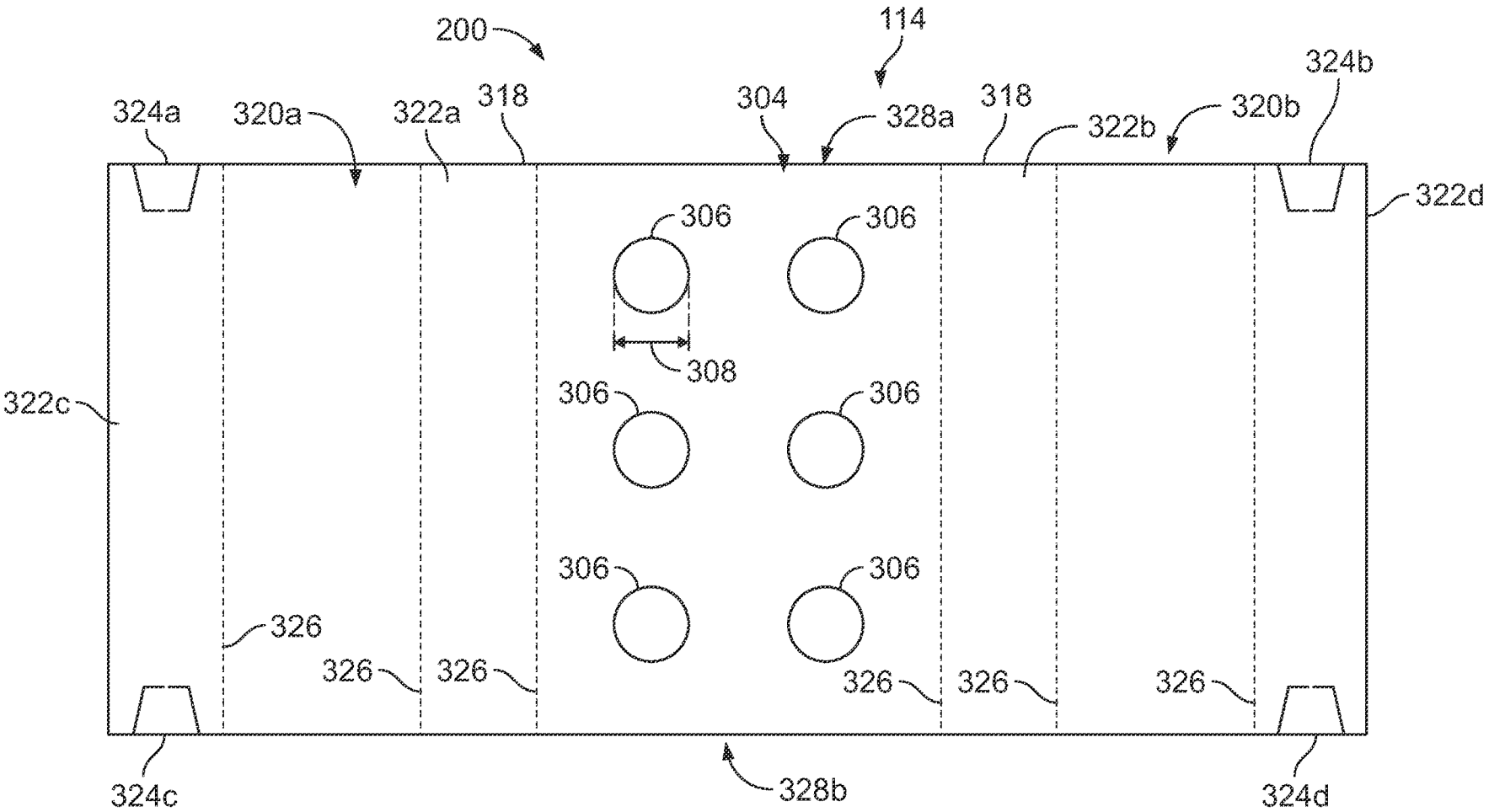
FIG. 3A is a top view an example unfolded top cushion support structure of FIG. 1.
Figure 3B:
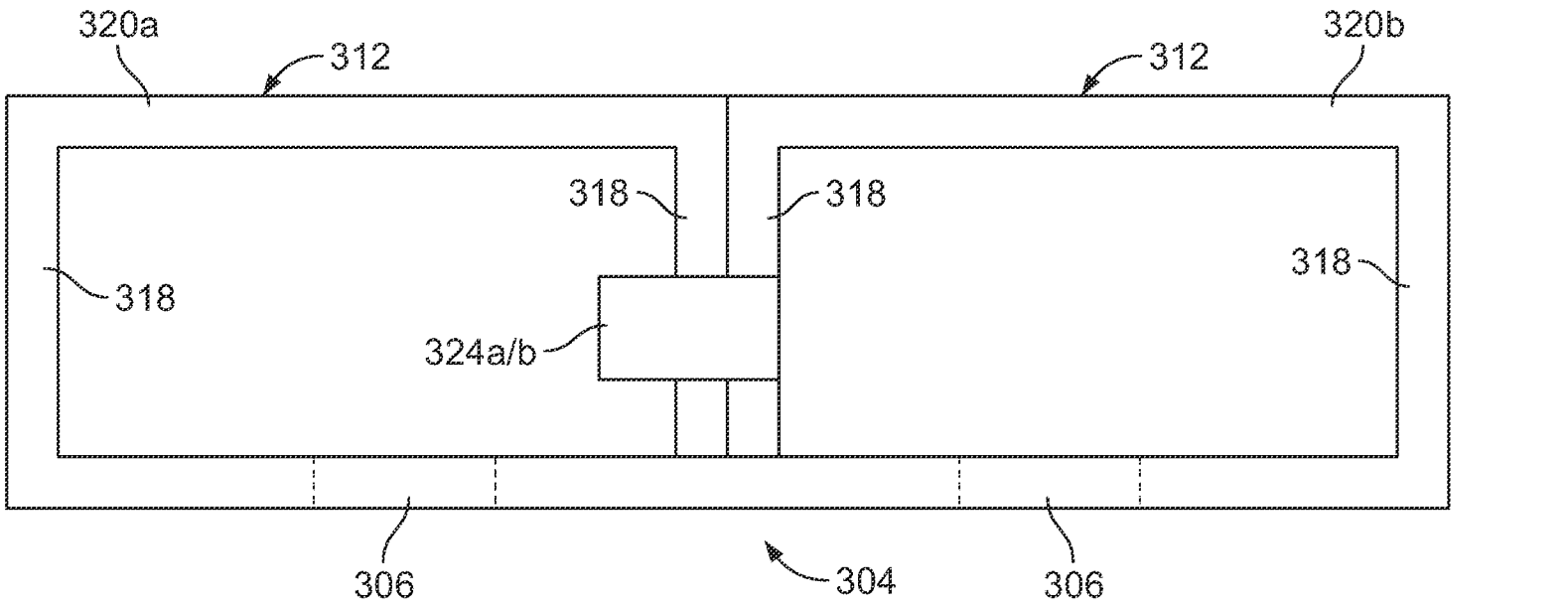
FIG. 3B is a side view an example folded top cushion support structure of FIG. 1.

FIG. 3A is a top view an example unfolded top cushion support structure 114 of FIG. 1 and FIG. 3B is a side view an example folded top cushion support structure 114 of FIG. 1. The unfolded top cushion support structure 114 is a paperboard sheet 200 which can be folded to form a folded top cushion support structure 114 (e.g., as shown in FIGS. 3C-3G). The paperboard sheet 200 can be a corrugated board sheet. The sheet 200 is formed into multiple regions 304, 322*a*, 322*b*, 320*a*, 320*b*, 322*c*, and 322*d* each separated by perforations 326. The regions, when folded at the perforations 326, form multiple layers (e.g., fourth or bottom layer 304, and fifth or top layer 312) and sidewalls. The center region forms the fourth or bottom layer 304 of the top cushion support structure 114. The bottom layer 304 includes multiple apertures 306. A pair of sidewall regions

322*a*, 322*b* border the center region (e.g., layer 304) on opposite sides. When folded, the sidewall regions 322*a*, 322*b* will form outer sidewalls 318 of the top cushion support structure 114. A pair of second regions 320*a*, 320*b* border each of the two sidewall regions 322*a*, 322*b*. When folded, the second regions 320*a*, 320*b* will form the top layer 312 of the top cushion support structure 114. A second pair of sidewall regions 322*c*, 322*d* border the second regions 320*a*, 320*b*. When folded, the second pair of sidewall regions 322*c*, 322*d* will from a second set of sidewalls 318 that support the top layer 312 and separate the top layer 312 from the bottom layer 304.

In some implementations, the second pair of sidewall regions 322*c*, 322*d* can include interlocking tabs 324*a*-324*d*. The interlocking tabs 324*a*-324*d* can be used to retain the top cushion support structure 114 in the folded configuration, e.g., as shown in FIGS. 3B and 3G.

FIGS. 3C-3G illustrate the steps of folding the top cushion support structure of FIG. 1. As explained in reference to FIG. 3A above, the top cushion support structure 114 includes a second paperboard sheet 200 folded to form a second set of layers 302 (shown in FIGS. 3D-3G) to retain the one or more shipping objects 110*a*-110*f* in a spaced-apart arrangement within the shipping container 102.

Referring to FIGS. 3C-3G, the second set of layers 302 includes a fourth horizontal layer 304. The fourth horizontal layer 304 includes multiple second apertures 306. The second aperture 306 is sized to retain a second end 308*a* of the first shipping object 110*a*. Likewise, each of the second apertures 306 are sized to retain second ends 308*b*-308*f* of each of the objects 110*b*-110*f*, respectively. Each of the second apertures 306 are arranged to align with one of the first apertures 208 of the bottom cushion support structure 112 when the bottom cushion support structure 112 the top cushion support structure 114 are positioned in the shipping container 102.

Each of the second apertures 306 can be the shape of a circle (as shown in FIGS. 3A-3G), a square, or a rectangle. Each of the second apertures 306 can be the same shape. Alternatively, one or more of second apertures 306 can be different shapes. Each of the second apertures 306 are sized to form a friction fit with the respective second ends 308*a*-308*f* of the shipping objects 110*a*-110*f*.

In some cases, the first apertures 208 and the second apertures 306 are the same shape. For example, as shown in FIGS. 2G and 3G, the shipping object is a circular glass bottle and both the first apertures 208 and the second apertures 306 are round. In other cases, the first apertures 208 and the second apertures 306 are the different shapes. For example, the first ends 210*a*-210*f* of the shipping objects 110*a*-110*f* can be square (not shown), while the respective second ends 308*a*-308*f* of the shipping objects 110*a*-110*f* are circular, such as shown in FIG. 3G with a cap 310*a* covering an opening (not shown) of the shipping object 110*a* for pouring the contents out of the shipping object 110*a*.

In some cases, the second apertures 306 are smaller than the first apertures 208. For example, a diameter 308 (shown in FIG. 3A) of the second aperture 306 can be smaller than a diameter 242 (shown in FIG. 2A) of the first aperture 208*a*. Sometimes, the second apertures 306 are larger than the first apertures 208. For example, a diameter 308 (shown in FIG. 3A) of the second aperture 306 can be larger than the diameter 242 (shown in FIG. 2A) of the first aperture 208. Still in other examples, the second apertures 306 are the same size as the first apertures 208. For example, a diameter 308 (shown in FIG. 3A) of the second aperture 306 is the same as the diameter 242 (shown in FIG. 2A) of the first aperture 208.

As shown in FIGS. 3D-3G, the second set of layers 302 includes a fifth horizontal layer 312. The fifth horizontal layer 312 is above fourth horizontal layer 304. The fifth horizontal layer 312 is spaced apart from the fourth horizontal layer 304 by a height 316 (shown in FIGS. 3E and 3G). In some cases, the fifth horizontal layer 312 includes two separate regions 320*a* and 320*b*.

The top cushion support structure 114 includes third sidewalls 318. The third sidewalls 318 couple the fourth horizontal layer 304 to the fifth horizontal layer 312. The third sidewalls 318 are sized to maintain the fourth horizontal layer 304 spaced apart from the fifth horizontal layer 312. In some implementations, the third sidewalls comprise at least four sidewalls. In some cases, all of the third sidewalls 318 (e.g., sidewall regions 322*a*-322*d*) are all of substantially equal height.

The top cushion support structure 114 includes a retaining tab 324*a*. The retaining tab 324*a* is mechanically coupled to the third sidewall 318. The retaining tab 324*a* creates a friction fit with the third sidewalls 318. When the retaining tab 324*a* is engaged to the middle two sidewalls 218, the retaining tab 324*a* retains the top cushion support structure 114 in a folded form. The top cushion support structure 114 includes retraining tabs 324*b*-324*d*, substantially similar to retaining tab 324*a*. Referring to FIGS. 3D-3E and 3G, retaining tabs 324*a* and 324*b* engage to retain the top cushion support structure 114 in a folded form. Likewise, retaining tabs 324*c* and 324*d* engage to retain the top cushion support structure 114 in a folded form.

As shown in FIG. 1, a width 116 and a length 118 of the bottom cushion support structure 112 substantially match inner dimensions of the shipping container 102. A width 120 and a length 122 of the top cushion support structure 114 substantially match the inner dimensions of the shipping container 102.

Each of the portions of the top cushion support structure 114 (the fourth horizontal layer 304, the sidewall portions 322*a*-322*d* of the third sidewall 318, and the two regions 320*a* and 320*b* of the fifth horizontal layer 312) have two common edges 328*a* and 328*b*. Referring to FIG. 3A, each of the regions of the top cushion support structure 114 are separated from each other by perforations 326. The regions of the unfolded top cushion support structure 114 are folded along the perforations 326 to form the folded top cushion support structure 114. The perforations 326 extend from the common edge 328*a* to the common edge 328*b*.

Figure 2C:
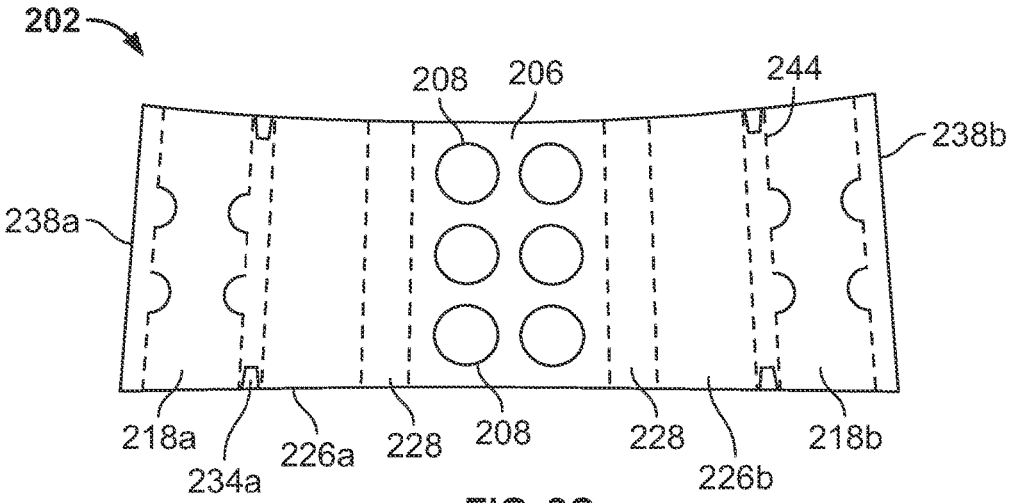
FIGS. 2C-2G illustrate the steps of folding the bottom cushion support structure of FIG. 1.
Figure 2D:
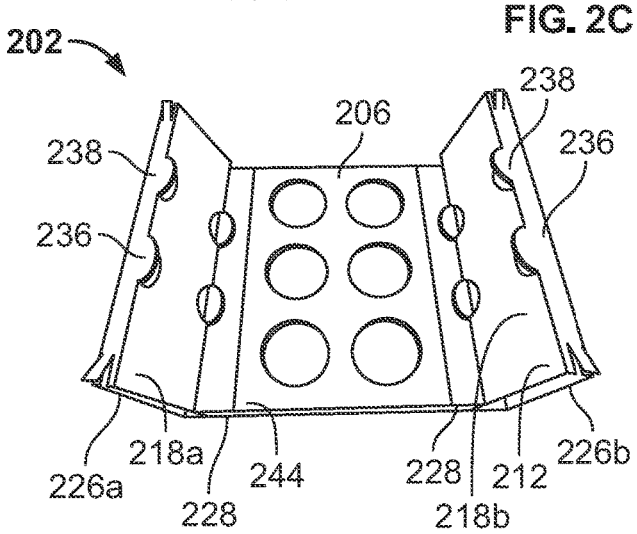
Figure 2E:
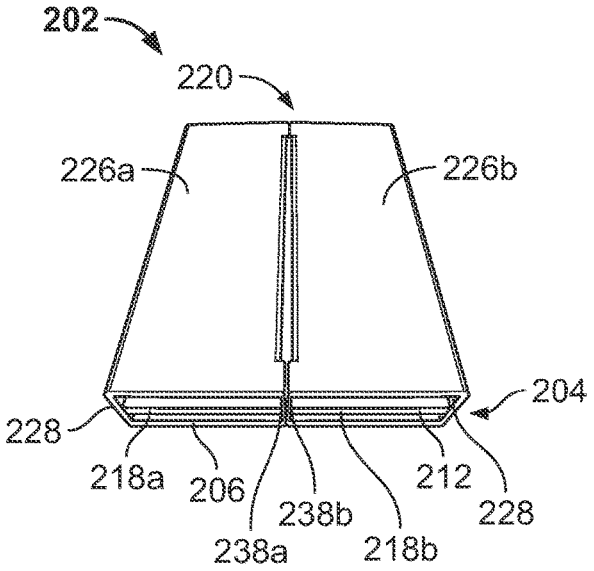
Figure 2F:
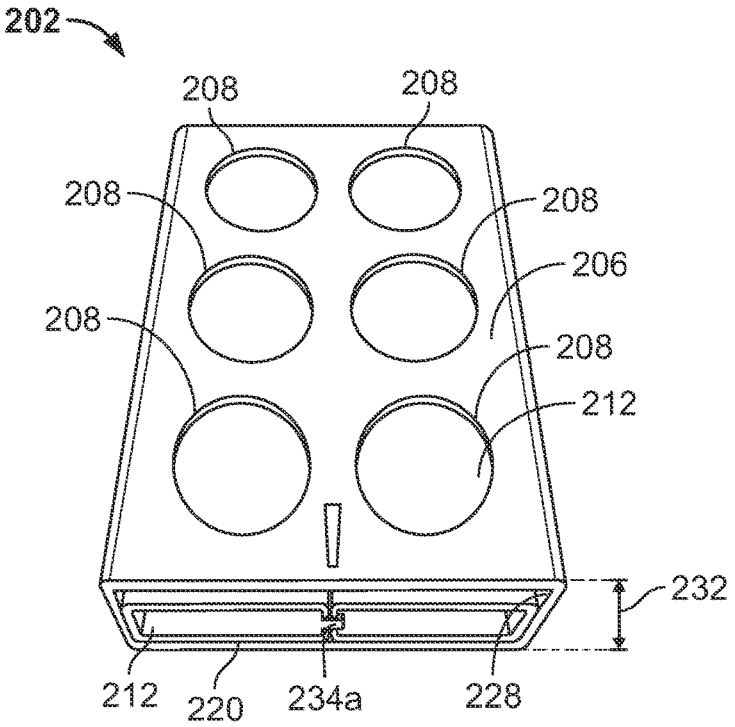
Figure 2G:
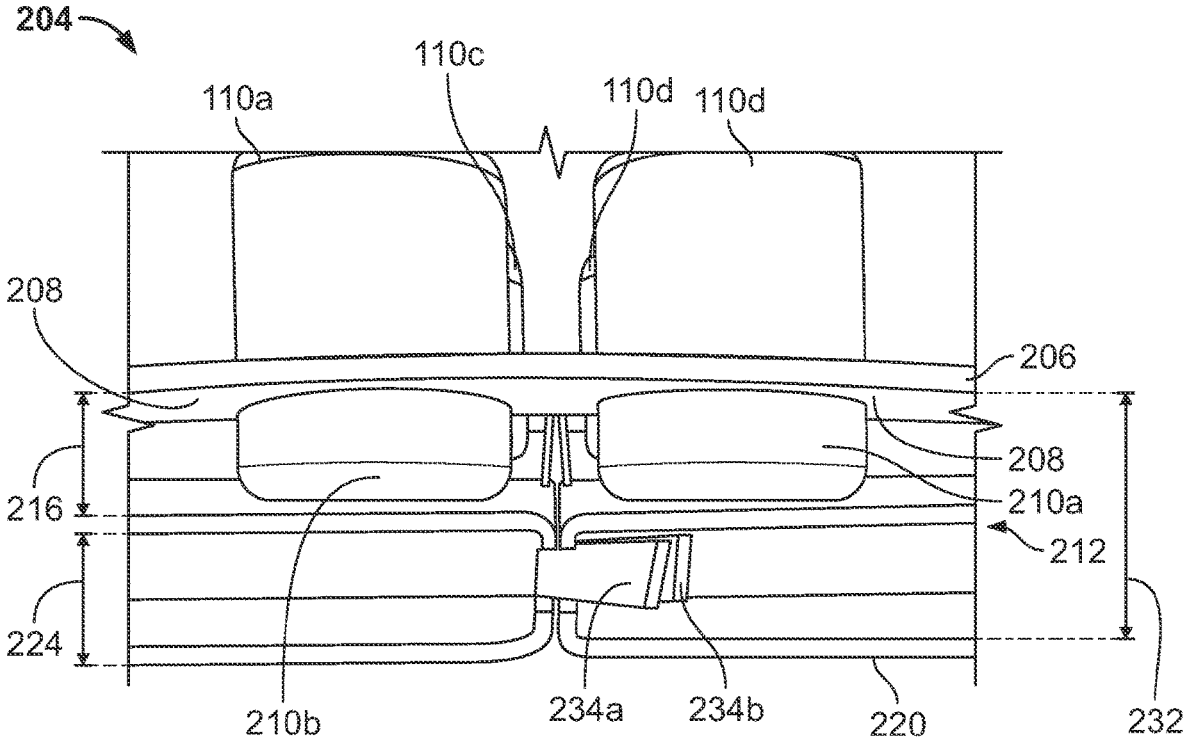

FIGS. 2C-2G illustrate a method of folding the unfolded paperboard sheet bottom cushion support structure 112 (shown in FIG. 2A) into the folded paperboard sheet bottom cushion support structure 112 (shown in FIG. 2G). FIGS. 2B-2D progressively show the second pair of sidewalls 230 folded over the pair of second regions 218*a* and 218*b*, which then continue to fold over the second sidewalls 230 to contact the pair of the third regions 226*a* and 226*b* and fully expose the support tabs 236. The folding continues until the support tabs 236 contact the first horizontal layer 206 and the first sidewalls 228 contact. Finally, the retaining tab 234*a* is engaged to the retaining tab 234*b* and the retaining tab 234*c* is engaged to the retaining tab 234*d* to retain the bottom cushion support structure 112 in a folded form.

Figure 3C:
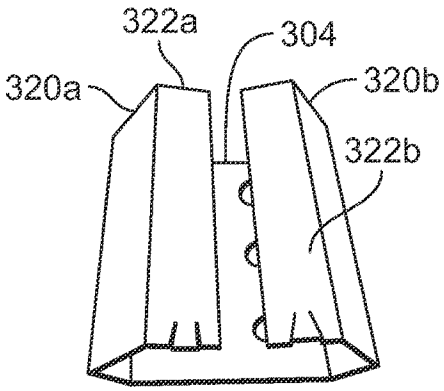
FIGS. 3C-3G illustrate the steps of folding the top cushion support structure of FIG. 1.
Figure 3E:
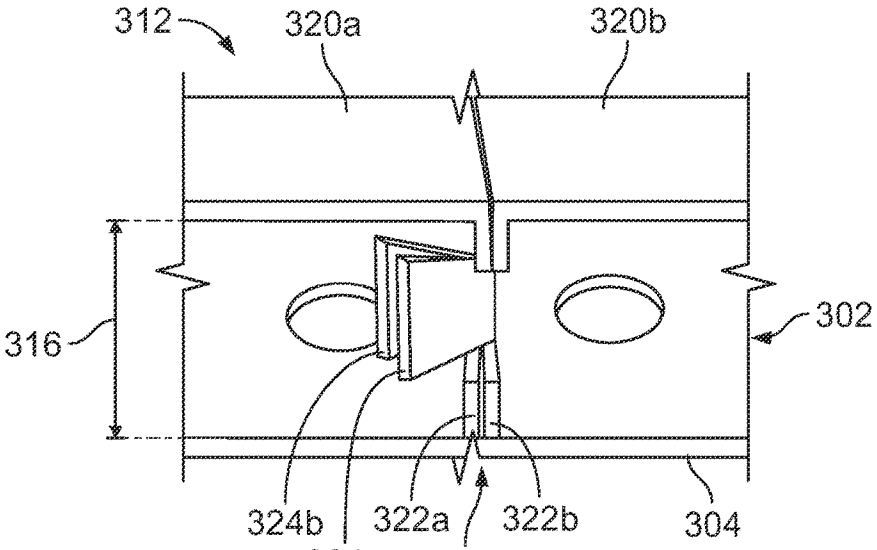
Figure 3D:
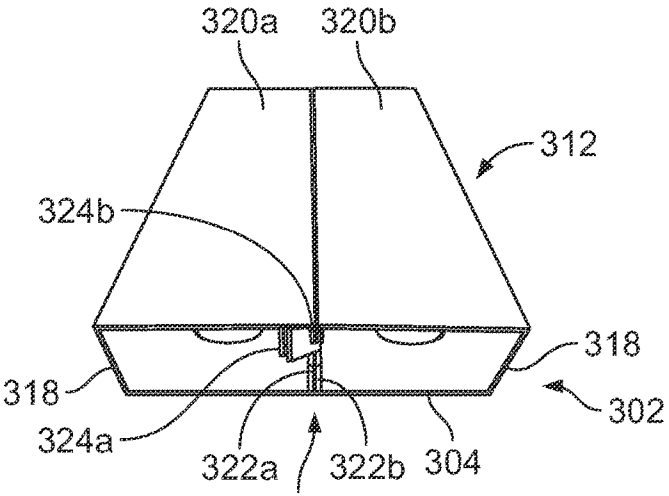
Figure 3F:
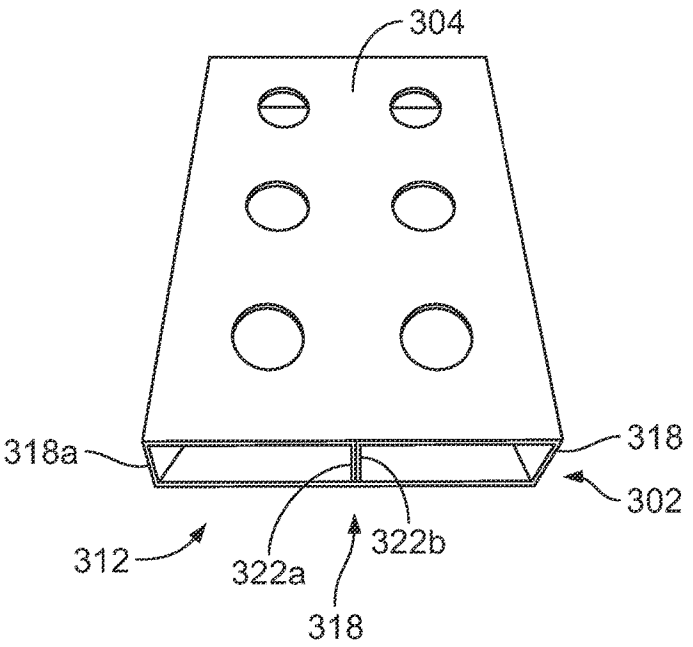
Figure 3G:
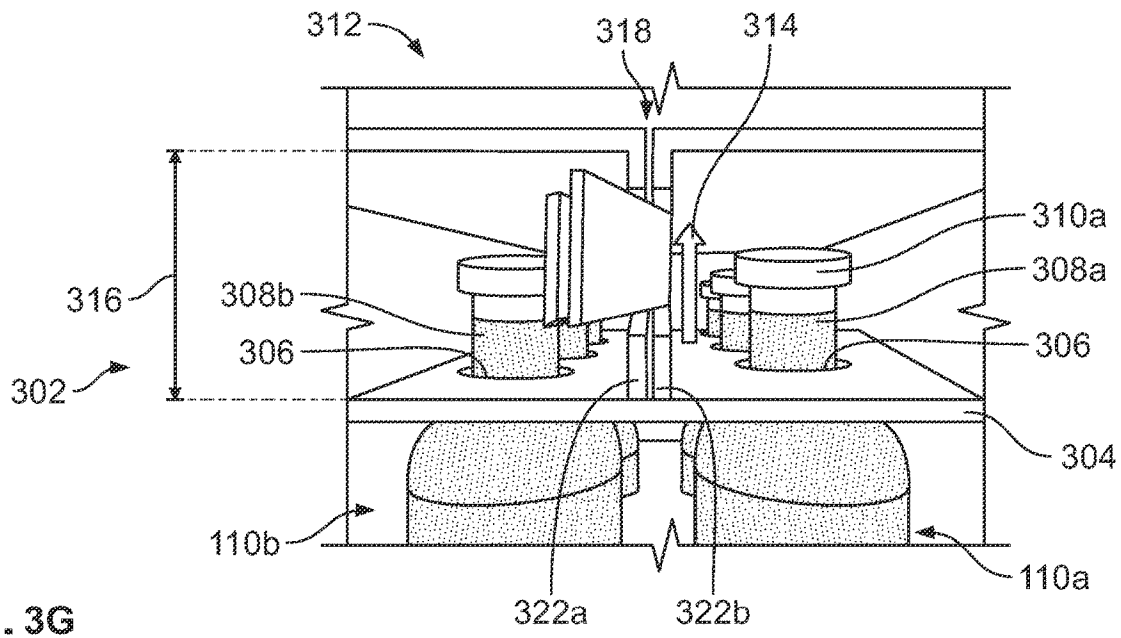

FIGS. 3C-3G illustrate a method of folding the unfolded paperboard sheet top cushion support structure 114 (shown in FIG. 3A) into the folded paperboard sheet top cushion support structure 114 (shown in FIG. 3F). FIGS. 3B-3D progressively show the first portion 322*c* and a second portion 322*d* (the third sidewall 318) folded inward over two separate regions 320*a* and 320*b* of the fifth horizontal layer 312, respectively. These are then folded over the third sidewalls 318*a* and 318*b* until the sidewall region 322*c* and the sidewall region 322*d* contact (shown in FIGS. 3D and 3E). Finally, in FIGS. 3F and 3G, the retaining tab 324*a* is engaged to the retaining tab 324*b* and the retaining tab 324*c* is engaged to the retaining tab 324*d* to retain the top cushion support structure 114 in a folded form.

Figure 4A:
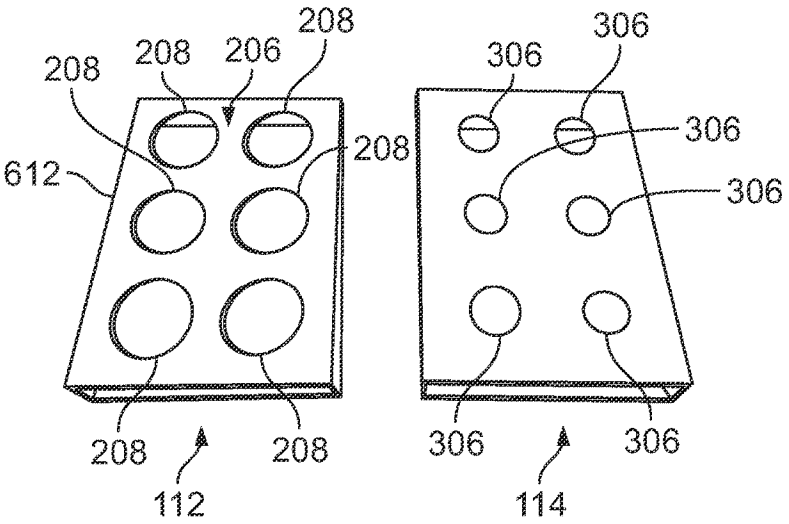
FIGS. 4A-4J illustrate steps of a method of assembling the shipping container and packaging cushion assembly of FIG. 1.

FIGS. 4A-4I illustrate steps of a method of assembling the shipping assembly of FIG. 1. FIGS. 4A-4I progressively show the shipping objects 110*a*-110*f* being coupled to the folded bottom cushion support structure 112 and the folded top cushion support structure 114 without a shipping container 102 for illustrative purposes. Referring to FIG. 4A, the folded bottom cushion support structure 112 and the folded top cushion support structure 114 are shown. The first apertures 208 are visible on the first horizontal layer 206. The second horizontal layer 212 is visible through the first apertures 208.

Figure 4B:
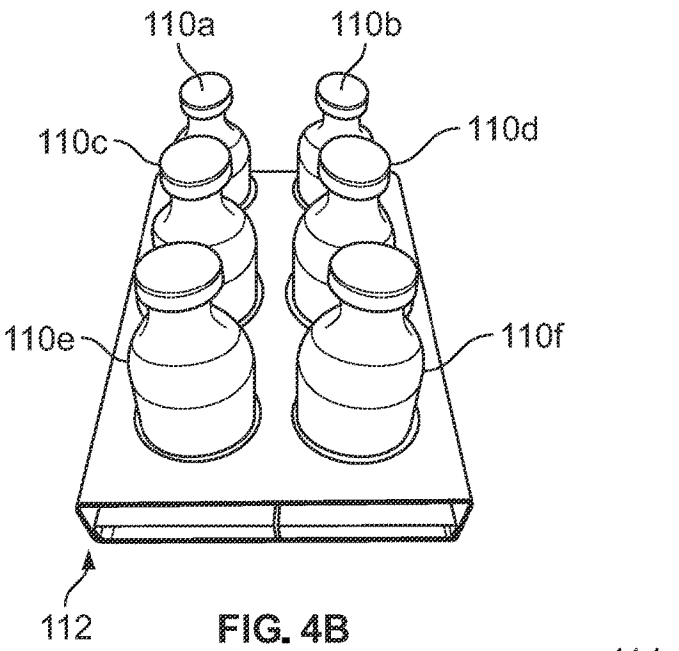

Referring to FIG. 4B, the shipping objects 110*a*-110*f* are placed in the first apertures 208. The shipping objects 110*a*-110*f* are pressed through the first apertures 208 until the shipping objects 110*a*-110*f* contact the second horizontal layer 212.

Figure 4C:
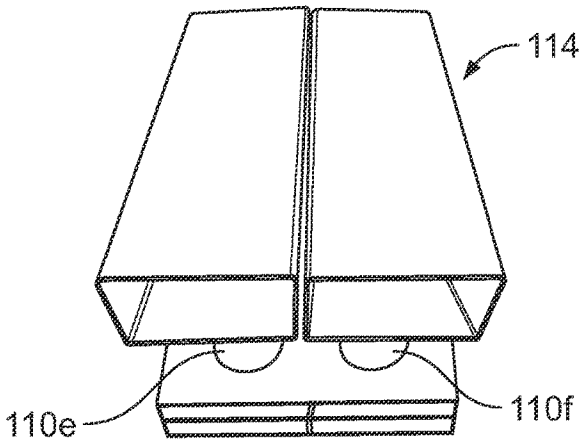
Figure 4D:
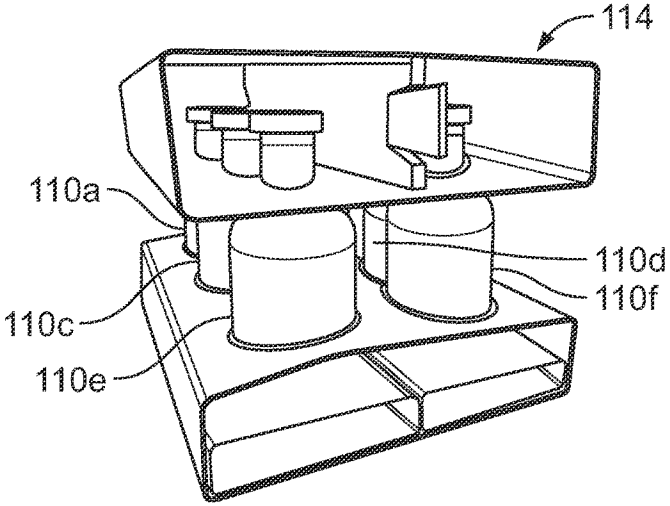

Referring to FIGS. 4C and 4D, the second apertures 306 are placed over the shipping objects 110*a*-110*f* and couple to the shipping objects 110*a*-110*f*.

Figure 4F:
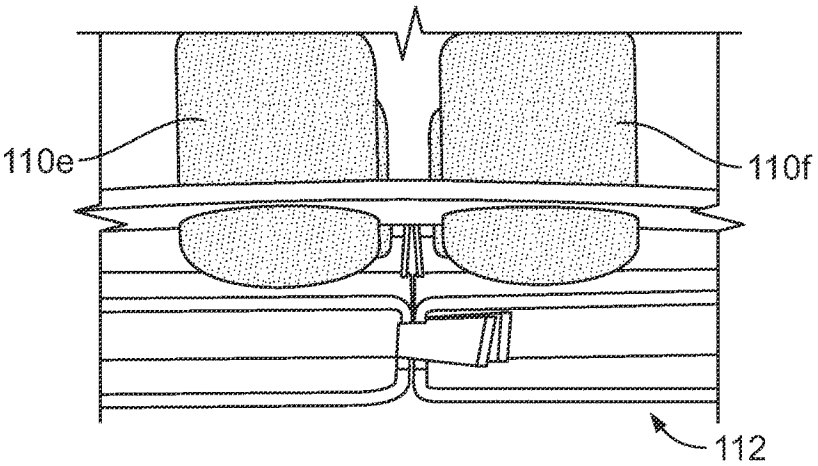
Figure 4H:
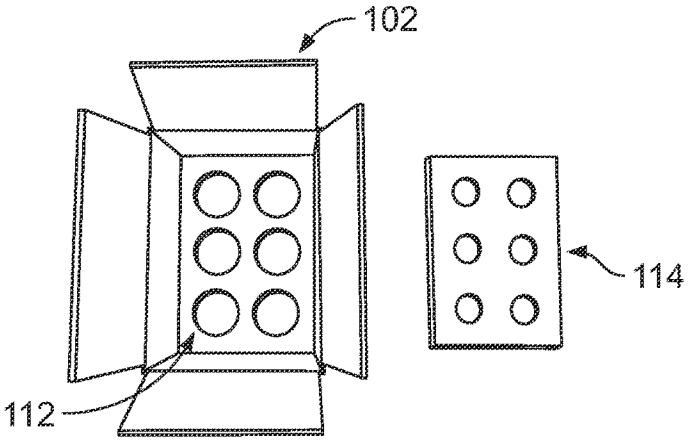
Figure 4E:
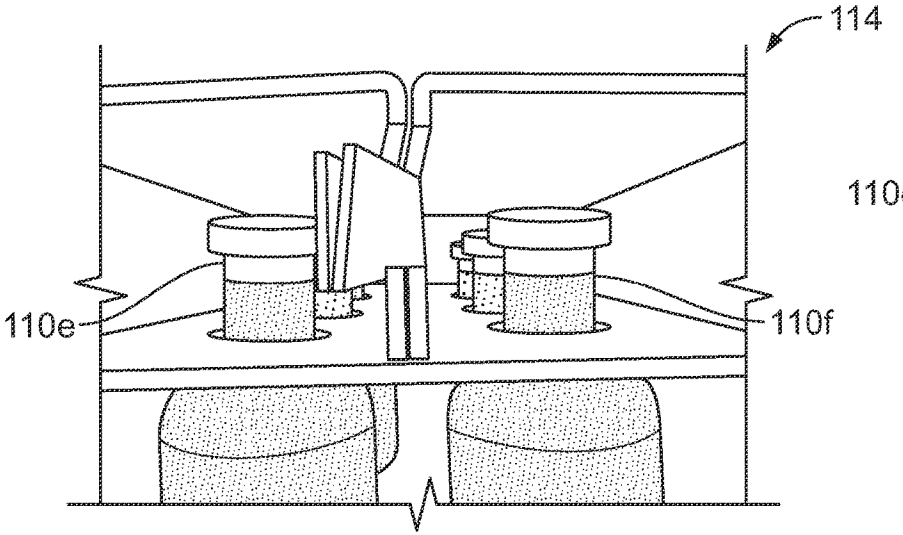

FIG. 4E shows the second ends 308*e* and 308*f* of two shipping objects 110*e* and 110*f* inside the top cushion support structure 114. FIG. 4F show the first ends 210*e* and 210*f* of two shipping objects 110*e* and 110*f* inside the bottom cushion support structure 112.

Figure 4G:
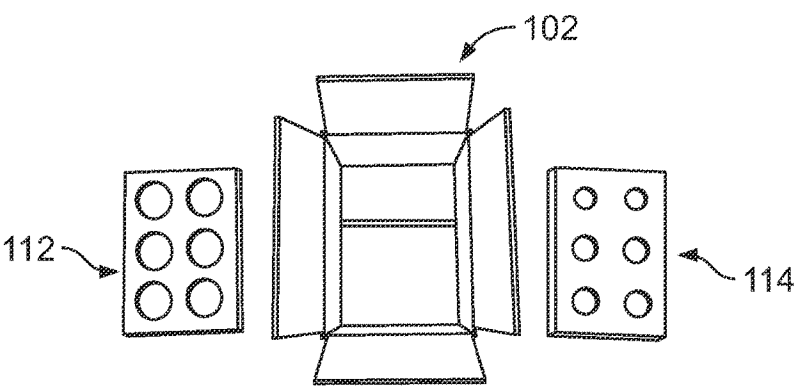
Figure 4J:
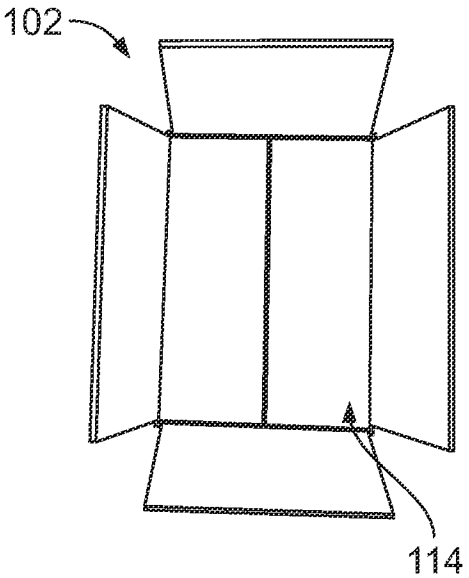
Figure 4I:
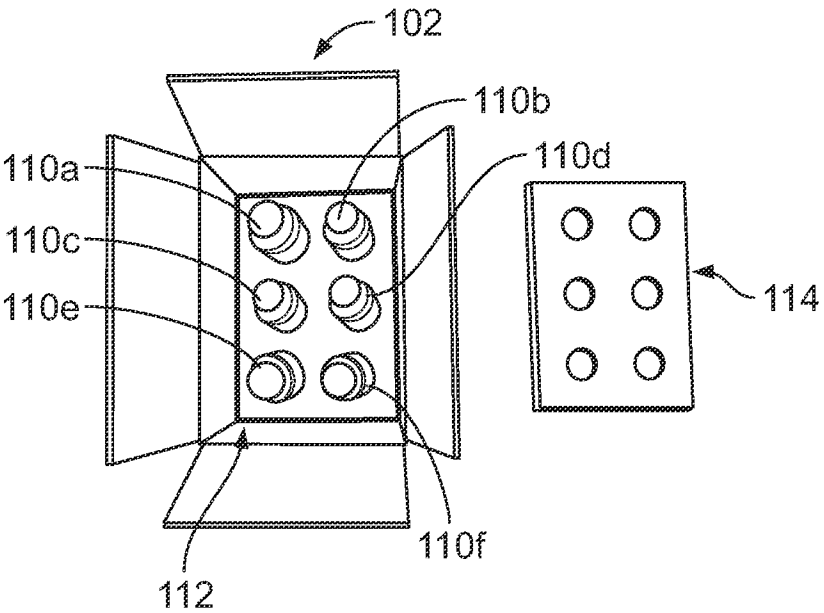

FIGS. 4G-4J progressively show the shipping objects 110*a*-110*f* being coupled to the folded bottom cushion support structure 112 and the folded top cushion support structure 114 into the shipping container 102. FIG. 4G shows the folded bottom cushion support structure 112, the folded top cushion support structure 114, and the shipping container 102 prepared for loading the shipping objects 110*a*-110*f*. FIG. 4H shows the folded bottom cushion support structure 112 placed inside the shipping container 102. FIG. 4I shows the shipping objects 110*a*-110*f* placed into the folded bottom cushion support structure 112 inside the shipping container 102. FIG. 4J shows the folded top cushion support structure 114 placed onto the shipping objects 110*a*-110*f* (no longer seen) inside the shipping container 102.

While this specification contains many specific implementation details, these should not be construed as limitations on the scope of any invention or on the scope of what may be claimed, but rather as descriptions of features that may be specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable sub-combination. Moreover, although features may be described above as acting in certain combinations and even initially claimed as such, one or more features from a claimed combination can in some cases be excised from the combination, and the claimed combination may be directed to a sub combination or variation of a sub-combination.

While this document contains many specific implementation details, these should not be construed as limitations on the scope of what may be claimed, but rather as descriptions of features that may be specific to particular implementations or embodiments. Certain features that are described in this specification in the context of separate embodiments can also be implemented in combination in a single embodiment. Conversely, various features that are described in the context of a single embodiment can also be implemented in multiple embodiments separately or in any suitable sub combination. Moreover, although features may be described above as acting in certain combinations and even initially claimed as such, one or more features from a claimed combination can, in some cases, be excised from the combination, and the claimed combination may be directed to a sub combination or variation of a sub combination.

The invention claimed is:

1. A shipping assembly comprising;

a shipping container; and a bottom structure configured to retain a plurality of objects in a spaced-apart arrangement within the shipping container, the bottom structure comprising a first paperboard sheet folded to form a first set of layers, the first set of layers comprising:

a first horizontal layer comprising a plurality of first apertures, each first aperture sized to retain a first end of one of the objects;

a second horizontal layer below and spaced apart from the first horizontal layer, the second horizontal layer comprising a substantially flat surface below the plurality of first apertures;

a third horizontal layer below and spaced apart from the second horizontal layer;

first sidewalls coupling the first horizontal layer to the third horizontal layer; and second sidewalls coupling the third horizontal layer to the second horizontal layer, wherein at least one of the second sidewalls comprises a retaining tab configured to create a friction fit with another one of the second sidewalls and retain the bottom structure in a folded form.

2. The shipping assembly of claim 1, wherein a height of the first sidewalls is greater than a height of the second sidewalls.

3. The shipping assembly of claim 2, wherein the first sidewalls are sized to maintain the first horizontal layer spaced apart from the third horizontal layer.

4. The shipping assembly of claim 2, wherein the second sidewalls are sized to maintain the second horizontal layer spaced apart from the third horizontal layer.

5. The shipping assembly of claim 2, wherein at least one of the second sidewalls comprises at least one support tab extending between the second horizontal layer and the first horizontal layer.

6. The shipping assembly of claim 5, wherein a height of the at least one support tab is substantially the same as a distance by which the second horizontal layer is spaced apart from the first horizontal layer.

7. The shipping assembly of claim 2, wherein the second sidewalls comprise a first pair of sidewalls and a second pair of sidewalls, the first pair located at opposite outer edges of the second horizontal layer and the second pair located approximately midway between the first pair.

8. The shipping assembly of claim 7, wherein the second pair of sidewalls comprise retaining tabs configured to create a friction fit between the second pair of sidewalls and retain the bottom structure in a folded form.

9. The shipping assembly of claim 7, wherein each sidewall of both the first pair and the second pair of sidewalls comprise at least one support tab extending between the second horizontal layer and the first horizontal layer.

10. The shipping assembly of claim 1, further comprising a top structure configured to retain the plurality of objects in a spaced-apart arrangement within the shipping container, the top structure comprising a second paperboard sheet folded to form a second set of layers, the second set of layers comprising:

a fourth horizontal layer comprising a plurality of second apertures, each second aperture sized to retain a second end of one of the objects, and each second aperture arranged to align with one of the first apertures of the bottom structure when the bottom structure and the top structure are positioned in the shipping container; and a fifth horizontal layer above and spaced apart from the fourth horizontal layer.

11. The shipping assembly of claim 10, wherein the top structure comprises third sidewalls coupling the fourth horizontal layer to the fifth horizontal layer, and wherein the third sidewalls are sized to maintain the fourth horizontal layer spaced apart from the fifth horizontal layer.

12. The shipping assembly of claim 11, wherein the third sidewalls comprise at least four sidewalls of substantially equal height, and wherein at least one of the third sidewalls comprises a retaining tab configured to create a friction fit with another one of the third sidewalls and retain the top structure in a folded form.

13. The shipping assembly of claim 10, wherein the first apertures are sized to form a friction fit with the first end of the objects, and wherein the second apertures are sized to form a friction fit with the second end of the objects.

14. The shipping assembly of claim 10, wherein a width and a length of the bottom structure substantially match inner dimensions of the shipping container, and wherein a width and a length of the top structure substantially match the inner dimensions of the shipping container.

15. A shipping assembly comprising;

a shipping container; and a bottom structure configured to retain a plurality of objects in a spaced-apart arrangement within the shipping container, the bottom structure comprising a first paperboard sheet folded to form a first set of layers, the first set of layers comprising:

a first horizontal layer comprising a plurality of first apertures arranged in at least two parallel rows, each first aperture sized to retain a first end of one of the objects;

a second horizontal layer below and spaced apart from the first horizontal layer, the second horizontal layer comprising a substantially flat surface below the plurality of first apertures, and at least one support tab extending between the second horizontal layer and the first horizontal layer and aligned with a region of the first horizontal layer that is between two rows of the first apertures;

a third horizontal layer below and spaced apart from the second horizontal layer;

first sidewalls coupling the first horizontal layer to the third horizontal layer, the first sidewalls being sized to maintain the first horizontal layer spaced apart from the third horizontal layer;

second sidewalls coupling the third horizontal layer to the second horizontal layer.

16. The shipping assembly of claim 15, further comprising a top structure configured to retain the plurality of objects in a spaced-apart arrangement within the shipping container, the top structure comprising a second paperboard sheet folded to form a second set of layers, the second set of layers comprising:

a fourth horizontal layer comprising a plurality of second apertures, each second aperture sized to retain a second end of one of the objects, and each second aperture arranged to align with one of the first apertures of the bottom structure when the bottom structure and the top structure are positioned in the shipping container;

a fifth horizontal layer above and spaced apart from the fourth horizontal layer; and third sidewalls coupling the fourth horizontal layer to the fifth horizontal layer, and wherein the third sidewalls are sized to maintain the fourth horizontal layer spaced apart from the fifth horizontal layer.

17. A shipping assembly comprising;

a shipping container; and a bottom structure configured to retain a plurality of objects in a spaced-apart arrangement within the shipping container, the bottom structure comprising a first paperboard sheet folded to form a first set of layers, the first set of layers comprising:

a first horizontal layer comprising a plurality of first apertures, each first aperture sized to retain a first end of one of the objects;

a second horizontal layer below and spaced apart from the first horizontal layer, the second horizontal layer comprising a substantially flat surface below the plurality of first apertures;

a third horizontal layer below and spaced apart from the second horizontal layer;

first sidewalls coupling the first horizontal layer to the third horizontal layer; and second sidewalls coupling the third horizontal layer to the second horizontal layer, wherein the second sidewalls comprise a first pair of sidewalls and a second pair of sidewalls, the first pair located at opposite outer edges of the second horizontal layer and the second pair located approximately midway between the first pair.

18. The shipping assembly of claim 17, wherein at least one of the second sidewalls comprises at least one support tab extending between the second horizontal layer and the first horizontal layer.

19. The shipping assembly of claim 18, wherein at least one of the second sidewalls comprises a retaining tab configured to create a friction fit with another one of the second sidewalls and retain the bottom structure in a folded form.

20. The shipping assembly of claim 17, further comprising a top structure configured to retain the plurality of objects in a spaced-apart arrangement within the shipping container, the top structure comprising a second paperboard sheet folded to form a second set of layers, the second set of layers comprising:

a fourth horizontal layer comprising a plurality of second apertures, each second aperture sized to retain a second end of one of the objects, and each second aperture arranged to align with one of the first apertures of the bottom structure when the bottom structure and the top structure are positioned in the shipping container; and a fifth horizontal layer above and spaced apart from the fourth horizontal layer.

* * * * *